US005246178A

United States Patent [19]

Badiali et al.

[11] Patent Number: 5,246,178

[45] Date of Patent: Sep. 21, 1993

[54] DEVICE FOR ANCHORING THREAD TO THE SURFACE OF A WINDING BOBBIN

[75] Inventors: Roberto Badiali; Luigi Colli, both of Pordenone; Giuseppe D. Bo, Roveredo in Piano, all of Italy

[73] Assignee: Savio S.p.A., Pordenone, Italy

[21] Appl. No.: 896,748

[22] Filed: Jun. 9, 1992

Related U.S. Application Data

[63] Continuation-in-part of Ser. No. 622,930, Dec. 6, 1990, abandoned.

[30] Foreign Application Priority Data

Dec. 12, 1989 [IT] Italy ..... 22665 A/89

[51] Int. Cl.[5] ..... B65H 67/04

[52] U.S. Cl. ..... 242/18 PW; 242/35.5 A

[58] Field of Search ..... 242/18 PW, 18 A, 35.5 A

[56] References Cited

U.S. PATENT DOCUMENTS

| | | | |
|---|---|---|---|
| 2,772,054 | 11/1956 | Herele et al. | 242/18 A |
| 2,789,774 | 4/1957 | Petersen et al. | 242/18 A |
| 2,905,402 | 9/1959 | Foller et al. | 242/18 A |
| 2,957,635 | 10/1960 | Bisbe | 242/18 A |
| 3,075,714 | 1/1963 | Perraut et al. | 242/18 A |
| 3,076,614 | 2/1963 | Baer | 242/18 A |
| 3,118,625 | 1/1964 | Kuster | 242/18 A |
| 3,429,514 | 2/1969 | Pospisil et al. | 242/18 A |
| 3,940,076 | 2/1976 | Kato et al. | 242/18 A |
| 5,083,716 | 1/1992 | Colli et al. | 242/35.5 A |

FOREIGN PATENT DOCUMENTS

| | | |
|---|---|---|
| 2248223 | 5/1975 | France . |
| 2326372 | 4/1977 | France . |
| 1050882 | 12/1966 | United Kingdom . |
| 2039552A | 8/1980 | United Kingdom . |

*Primary Examiner*—Stanley N. Gilreath
*Attorney, Agent, or Firm*—Robert D. Schaffer

[57] ABSTRACT

An apparatus and method for anchoring thread to the surface of a bobbin, the apparatus including a movable arm for grasping the bobbin and a lever attached to the movable arm, the lever having two members for engaging the surface of the bobbin with one of the members being a roller. The movable arm places the bobbin in a mandrel, and a second movable arm moves the thread between the roller and the surface of the bobbin. The roller is then brought into contact with the surface of the bobbin and the mandrel is rotated to thereby wind the thread onto the bobbin. The second movable arm includes a cutting blade for cutting the thread, and a hook and movable lever for moving the thread into position.

4 Claims, 5 Drawing Sheets

5
21
16
8
18
20
13
6
2
9
1
12
22
3
10
14
7
11
15
7

DEVICE FOR ANCHORING THREAD TO THE SURFACE OF A WINDING BOBBIN

This application is a continuation-in-part of application Ser. No. 07/622,930, filed on Dec. 6, 1990, now abandoned.

DESCRIPTION

The present invention relates to a device that may be carriage-mounted and which enables the initial end of the thread to be anchored to the surface of a winding bobbin on which the reel is being formed and the said anchorage is made in the section of axial travel of the windings of criss-cross thread. It is known that on completion of the spinning or spooling process the "thread" product is normally supplied in criss-cross-wound cylindrical or conical reels. The said reels may be of any shape and size and in the Description and Claims shall simply be called textile cops, or reels, or yarn packages using these terms interchangeably. In some cases where in subsequent stages of the production process the known reserve of initial windings of thread wound in a section of cop located exterior to the axial extent of the wound thread is not used, because the end of a spent reel need not be joined to the beginning of another new reel without stopping the machine or process in progress, in such cases it is a great advantage to begin winding the thread onto the bobbin in a section inside the axial extent of the wound thread. For example, the above-mentioned cases apply in double-twist twisting frames or in the operation of doubling two or more threads wound on reels. Clearly, in the said cases and in other cases with similar requirements, the formation of one or more initial coils of thread wound onto the bobbin, located at one end and exterior to the axial extent, constitutes a waste of material and loss of time to remove the said coils of thread while the reel is being used, since the said coils are often frayed due to the damaging crushing and friction action of the supply cylinder. In the current state of the art automatic spoolers exist which have reel-carrier arms with mandrels (centres) the function of which is to carry, centre and fix the bobbin, but also to enable the first coils of the start of reel formation to be wound onto the bobbin. The said first coils are usually formed by securing the thread end, with a known device, at the start of the spooling cycle between the end of the bobbin and the mandrel (centre) of the reel-carrier arm. In current winding machines, such as automatic spoolers, automatic cutting of the thread between the reel of thread and clamping in the mandrel does not take place during winding for the formation of the reel. In this way when the reel is removed on completion of winding, to replace it with an empty bobbin, the said completed reel will be moved by means of chutes or conveyor belts, along which the section of thread previously gripped between the bobbin and mandrel will be free and hanging down often causing the said initial winding coils to unwind. This will give rise to a free thread end of a certain length which while the reel is being transported and moved will inadvertently join with the free thread ends of other reels. As a result the free thread ends become entangled and these tangles create considerable problems when the reels must be separated. In this case, intervention by an operator to cut the said joins and eliminate the dangers of blockage in the transportation and movement of reels to subsequent production stages is absolutely unavoidable. Manual intervention by the service operator is certainly not the best method of obtaining proper reliability of the movement of reels. Understandably, in operational tasks performed by chance, and therefore operations which are not scheduled and regular in time, labour performance is low. Another aspect which is certainly of no less importance is that tail ends of thread hanging from the reels supplying the double-twist twisting frames interfere with the threads being unwound which are drawn close to be twisted together. This interference often causes one of the two threads to break thus interrupting the double-twist twisting process. Stoppages of production like those mentioned above, even if reduced to a low percentage incidence, with the high rate of production in today's machines, take on considerable importance due the delays they involve in restarting the production cycle. To overcome the above-mentioned problems, the Applicant has tried and tested a device of definite reliability for hooking the thread onto the winding bobbin, inside the axial extent of the thread contained on the thread package being formed, without thus leaving at the end of winding any section of free hanging thread. The said device has been successfully installed by the Applicant on the movable lifting carriage at the reel winding front. This avoids high installation costs since the device in question uses for its housing and its movement a movable carriage which is already in existence, and this in itself, apart from being extremely advantageous, is also very safe and provides an excellent solution to both the general and specific problems posed by such a problematical situation.

The present invention is therefore proposed not only to relieve service personnel of the task of dealing with the above-mentioned entanglement of free threads from the reels, but also has the aim of ensuring correct operation as regards twisting and doubling. In accordance with this the present invention relates to a device which enables the initial end of thread to be anchored to the surface of the winding bobbin on which the reel is being formed comprising in reciprocal co-operation and co-ordination:

an arm which picks up, holds and places the bobbin between the centres of the reel-holder mandrel and the said arm also supports a curved lever which rests initially, with an essentially flat end, against the surface of the bobbin and subsequently, after securing the bobbin between the centres, the said lever rests pushing against the surface of the bobbin with a roller fixed freely close to its essentially flat end and the said roller holds the thread tightly against the circumferential surface of the bobbin at a point inside the axial extent of the thread contained on the thread package being formed and for the entire time required to wind on the first coils of wound thread;

a linkage which has a gripper element, a cutter element and a rod-shaped element for moving the thread underneath the above-mentioned roller and to the thread anchorage point, or section, and start of winding point on the bobbin to form the reel, as the package of thread to be obtained.

The curved lever, which is supported by the said arm, is constantly pushed against the surface of the bobbin by an elastic element, such as a spiral spring fitted round the rotation pin of the said lever. The starting point of anchorage of the thread to the surface of the bobbin is located in the section of axial length of the bobbin on which the thread is to be wound. In one embodiment the device covered by the present invention is housed in a carriage that moves along the entire winding front.

A preferred embodiment of the invention is now described, for the purpose of illustration but in no way limiting, with the help of the attached drawings in which:

FIG. 1 is a schematic side view of the device covered by the present invention and the said view shows the moment when the arm is holding the empty bobbin and the completed reel is descending a chute;

FIG. 2 is a schematic side view of the device covered by the present invention and the said view shows the moment when the arm has placed the bobbin between the centres of the reel-carrier mandrel and the curved lever is resting its essentially flat end on the bobbin and the said view also shows the rod-shaped element in the rotated position since it has moved the thread round the roller and into an axial position within the axial extent of the thread on the thread package to be formed;

Figure 3:
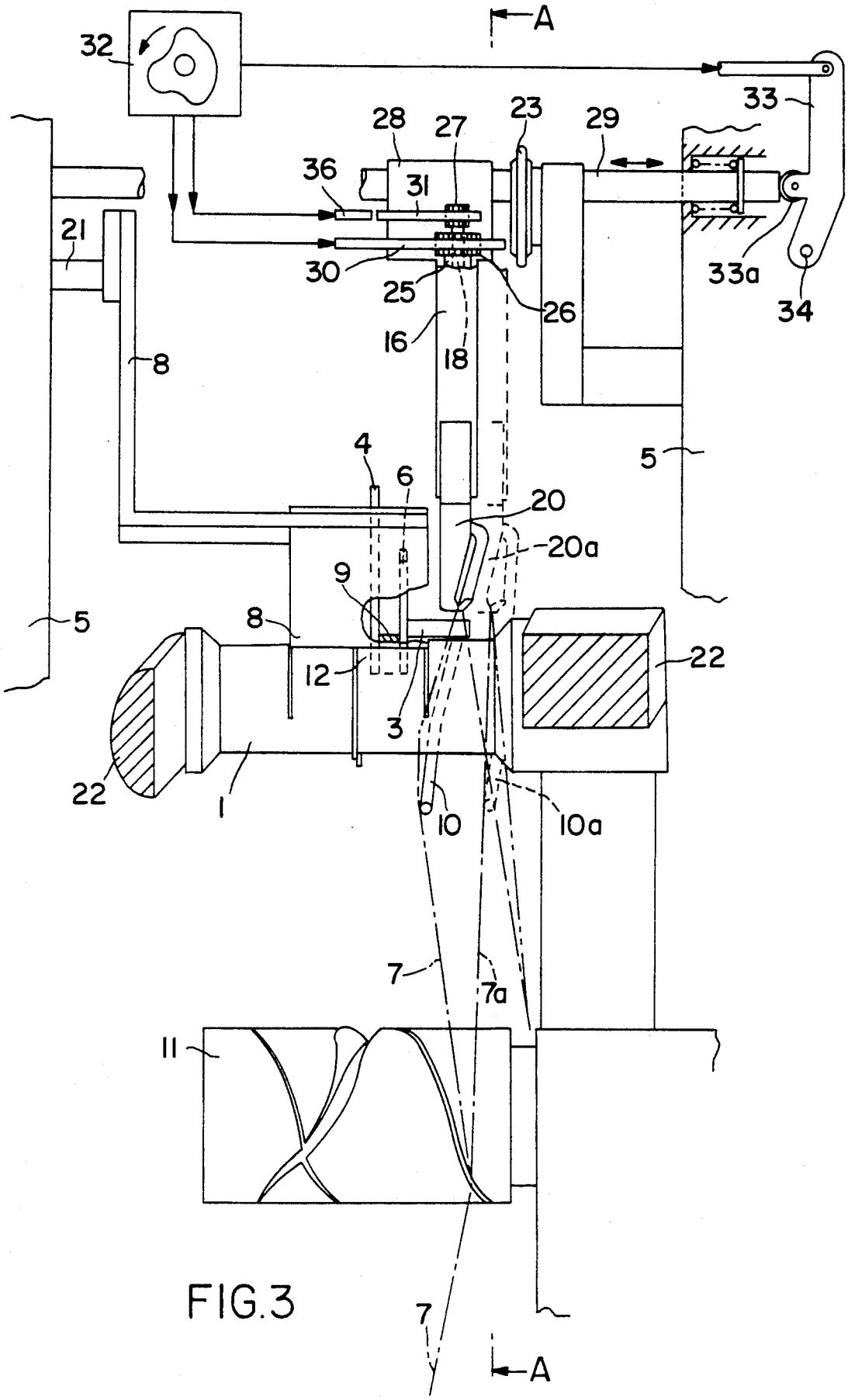
FIG. 3 is a front schematic view of the operating moment shown in FIG. 2 and also shows, in a raised at rest position, the friction wheel that will activate the rotation of the bobbin to deposit the first coils of wound thread.
Figure 4:
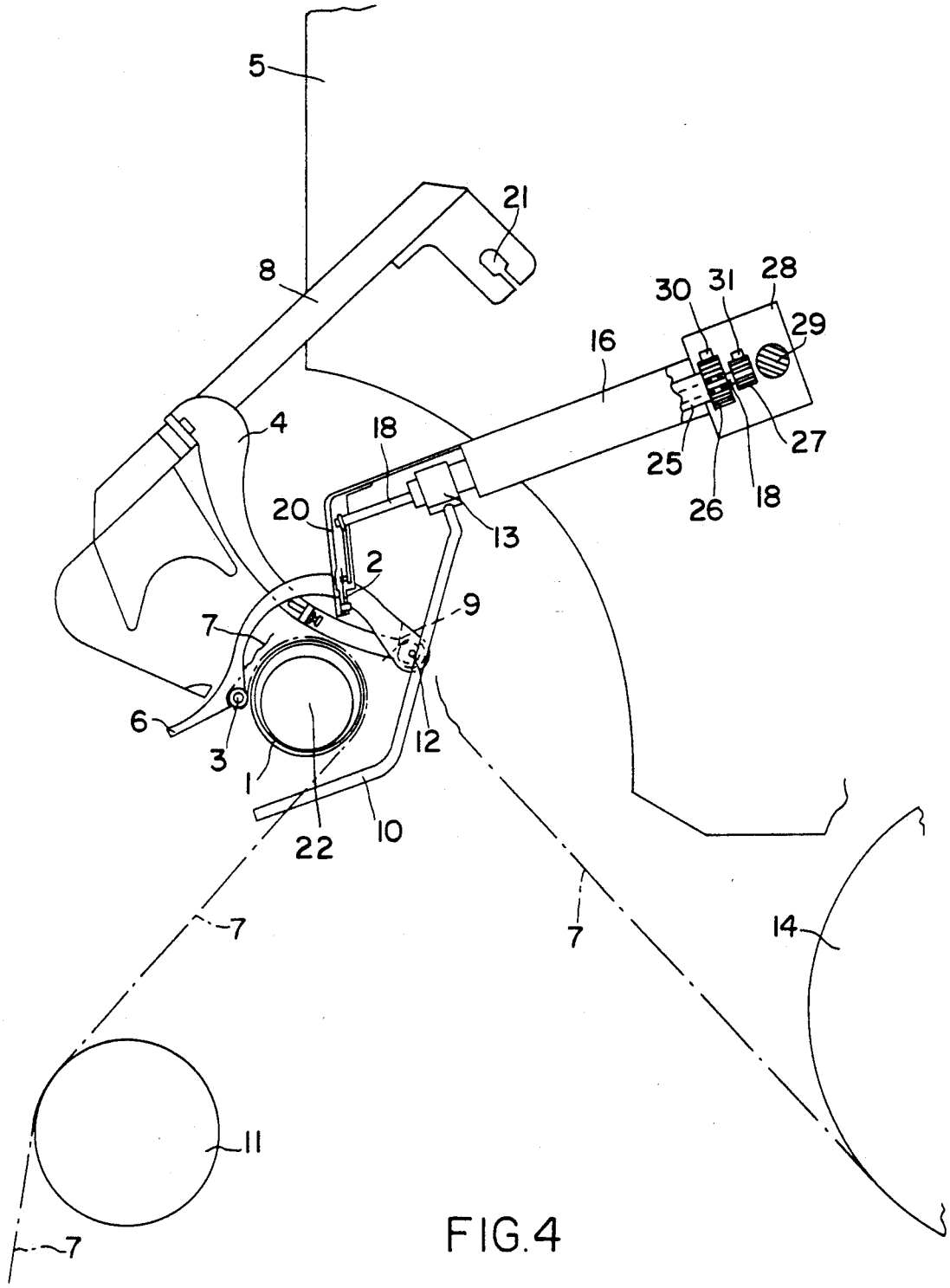
FIG. 4 is a schematic side view of the device covered by the present invention and the said view represents the moment when the roller of the lever is resting on the bobbin and holding the thread tightly against the circumferential surface of the said bobbin while the cutting element has cut the thread leaving the reel free to move along known conveyor belts.

In the Figures the same parts bear the same reference numbers for simplicity. The devices and mechanisms that operate in reciprocal co-operation with the device covered by the present invention are not shown and their operation is not described since they are already known, and also because they do not affect the operation of the invention in question. In the attached drawings: 1 is the bobbin supporting the criss-cross windings of thread for the formation of reel 14 of any shape and size, 2 is the cutting element of cutting blade advantageously positioned close to and coupled with gripper element 20. Cutter 2 and gripper 20 elements are activated and supported by a linkage which comprises a rod 18 moved by a pneumatic or electromechanical actuator 16; 3 is the roller fixed freely to curved lever 6; 4 is the supporting element or bar of lever 6. The said bar 4 is fixed as a single body at one of its ends to arm 8 and at the other end it has a pin 12 around which lever 6 pivots with the possibility of rotating; 5 is the outline of the movable lifting carriage which moves along the entire winding front and also houses the device covered by the present invention; 8 is the arm which picks up, holds and places bobbin 1 between the centres of reel-carrier mandrel 22. The said arm pivots and rotates round pin 21; 9 is a spiral spring fitted round pin 12 and the said spring 9 constantly pushes lever 6 against the surface of bobbin 1; 10 is the rod-shaped element which rotates around rod 18 by means of a bush element 13; 11 is the grooved supply cylinder or motor-roller driving the reel being formed (shown here schematically since it is irrelevant for the purposes of the present invention); 15 is the outline of a portion of movable sheeting which positions thread 7 and guides the fall of completed reel 14 as the latter is ejected; 23 is the friction wheel that activates the rotation of bobbin 1 to deposit the first coils of wound thread; A—A is the line of the cross-sectional plane and corresponds to the side views in FIGS. 1, 2 and 4. The means for controlling movement of the elements 10, 16, and 20 have been schematically shown in FIGS. 3 and 4.

Actuator 16 internally supports a sleeve 25, which rotates about the longitudinal axis of the actuator 16 and rigidly carries member 13 from which the rod element 10 projects. Element 10 has an angled configuration and is rotatable with the sleeve 25 substantially about an angle of 180° from the position shown in FIG. 1 to that shown in FIG. 4.

Rod element 18 is housed within the sleeve 25 of the actuator 16 and is pivotable about its longitudinal axis (corresponding to the longitudinal axis of the sleeve 25) over a small angle, sufficient to operate the cutter 2.

At the end opposite to the rod element 10, the sleeve 25 is rigid with a gear wheel 26. The rod 18 is rigid with a gear wheel 27. The actuator 16 is rigid with a support block 28 in which the gear wheels 26 and 27 are housed. The support block 28 is rigid with a shaft 29 and is supported on the carriage 5 so as to be slidable in the direction of the axis of the shaft 29 over a distance corresponding to positions **16*a* and 16 of the actuator 16**.

Element 20 is rigid with the actuator 16 and therefore moves therewith.

The gear wheels 26 and 27 are in meshing engagement with respective toothed bars 30 and 31 which are supported in the block 28 and extend parallel to the shaft 29. It is apparent that axial displacement of the toothed bars 30 and 31 relative to the block 28, provides rotation of the gear wheels 26 and 27 and thus both the rotational movement of the rod element 10 and the pivotal movement of the moveable blade of the cutter 2.

Axial movement of the toothed bars 30 and 31 is provided by a cam control 32 in the manner which will be described later. Axial movement of the shaft 29 is also made by the cam control 32 through a lever 33 pivoted at 34 on the carriage 5 and acting on one end of the shaft 29 with an actuation portion **33*a*. A spring 35 returns the shaft 29 to its rest position once actuation of the lever 33** ceases.

Figure 1:
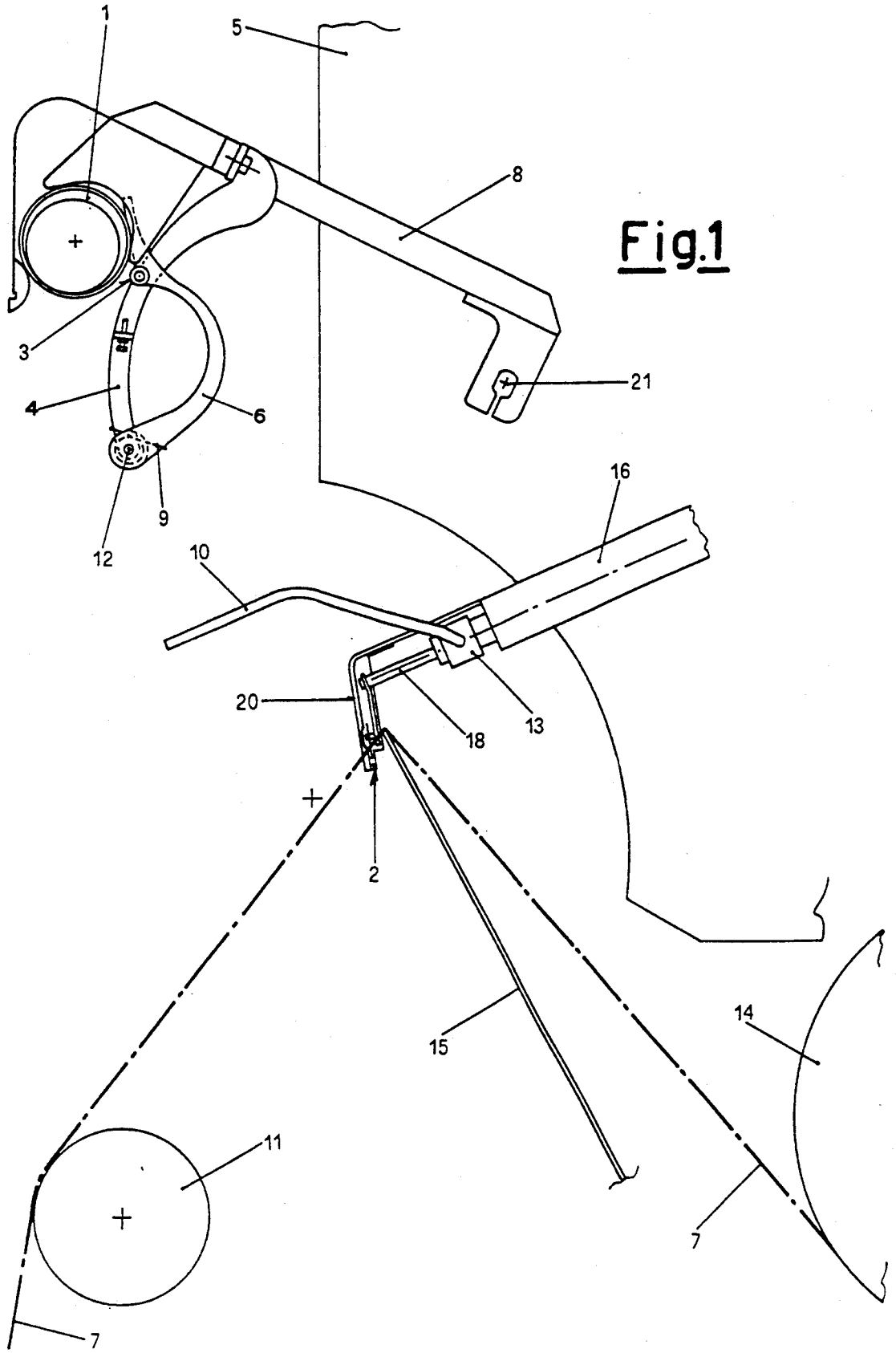
Figure 2:
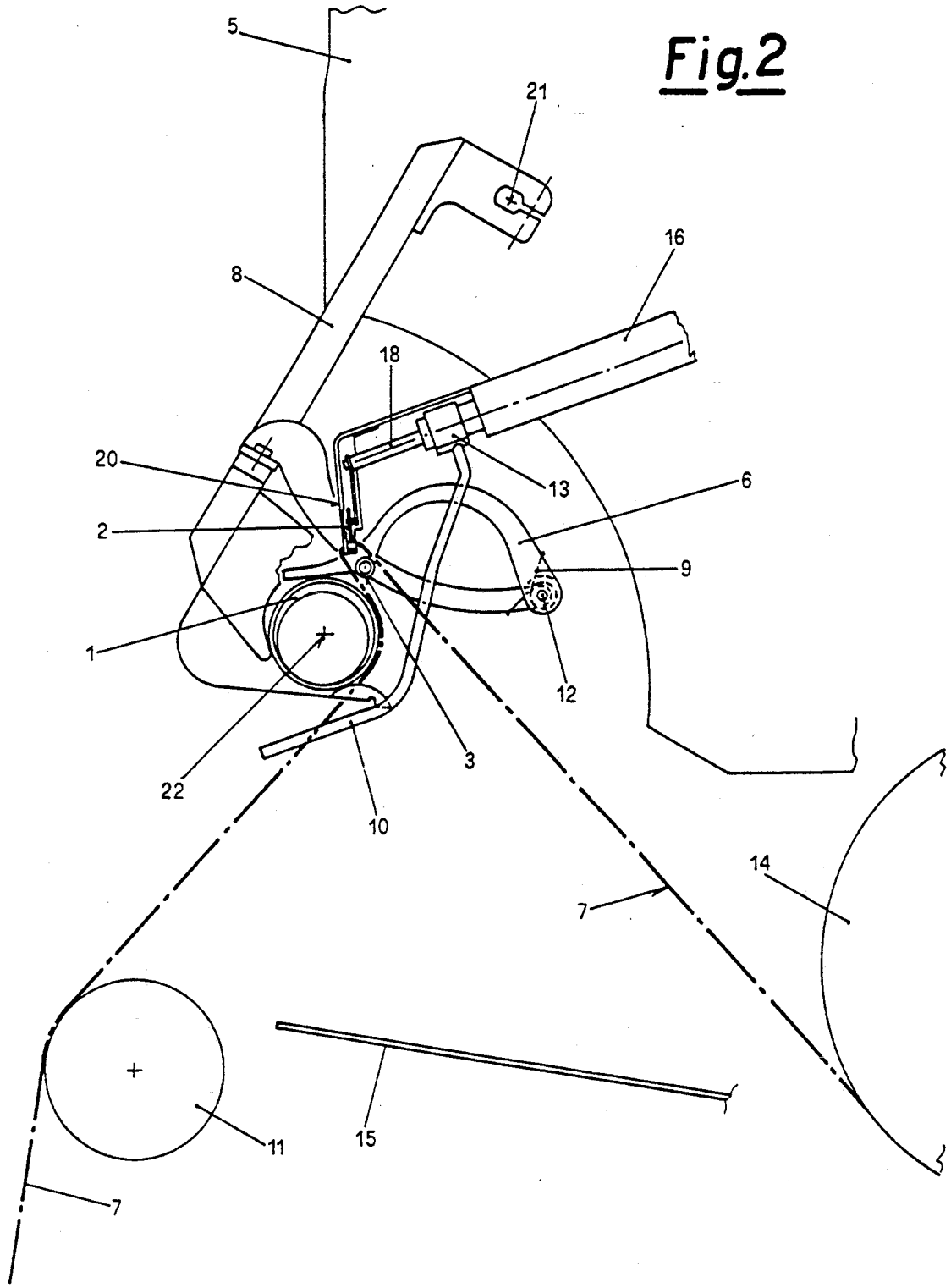

The cam control 32 first provides rotation of the element 10 from the position of FIG. 1 to that of FIG. 2. Subsequently the cam control 32 controls displacement of the shaft 29 and thus the shifting of the actuator 16 from position **16*a* to position 16. Simultaneously, the rod element 10 rotates from position 10*a* to position 10 because of the axial displacement of the block 28 with the actuator 16. The toothed bar 30 remains stationary, so that a limited rotation is imparted to the gear wheel 26 and thus to the element 10. Due to the fact that this latter element has a particularly angled configuration, this additional rotation causes it to assume a different position from what it would assume if it simply shifted with the actuator 16**.

At this state, the cutter 2 has not yet been operated. This is because the toothed bar 31 is separate from the actuator bar 36 and comes to lie adjacent thereto only when the actuator 16 is in the position shown with full lines in FIG. 3. Upon starting of the rotation of the bobbin (tube) 1 and winding of the initial thread coils on the bobbin 1, the cam control 32 operates displacement of the control bar 36 and causes the cutting element 2 to cut the thread.

As is well understood from the above, to those persons skilled in the art, the sequential controls for operating the device of the present invention are provided by a cam control as is usual in the art. The cam control also provides for other timed movements of elements of the device, for example, arm 8 and friction wheel 23. Obviously means different from those shown in FIGS. 3 and 4 and described above could be used for carrying out the movement described.

Figure 5:
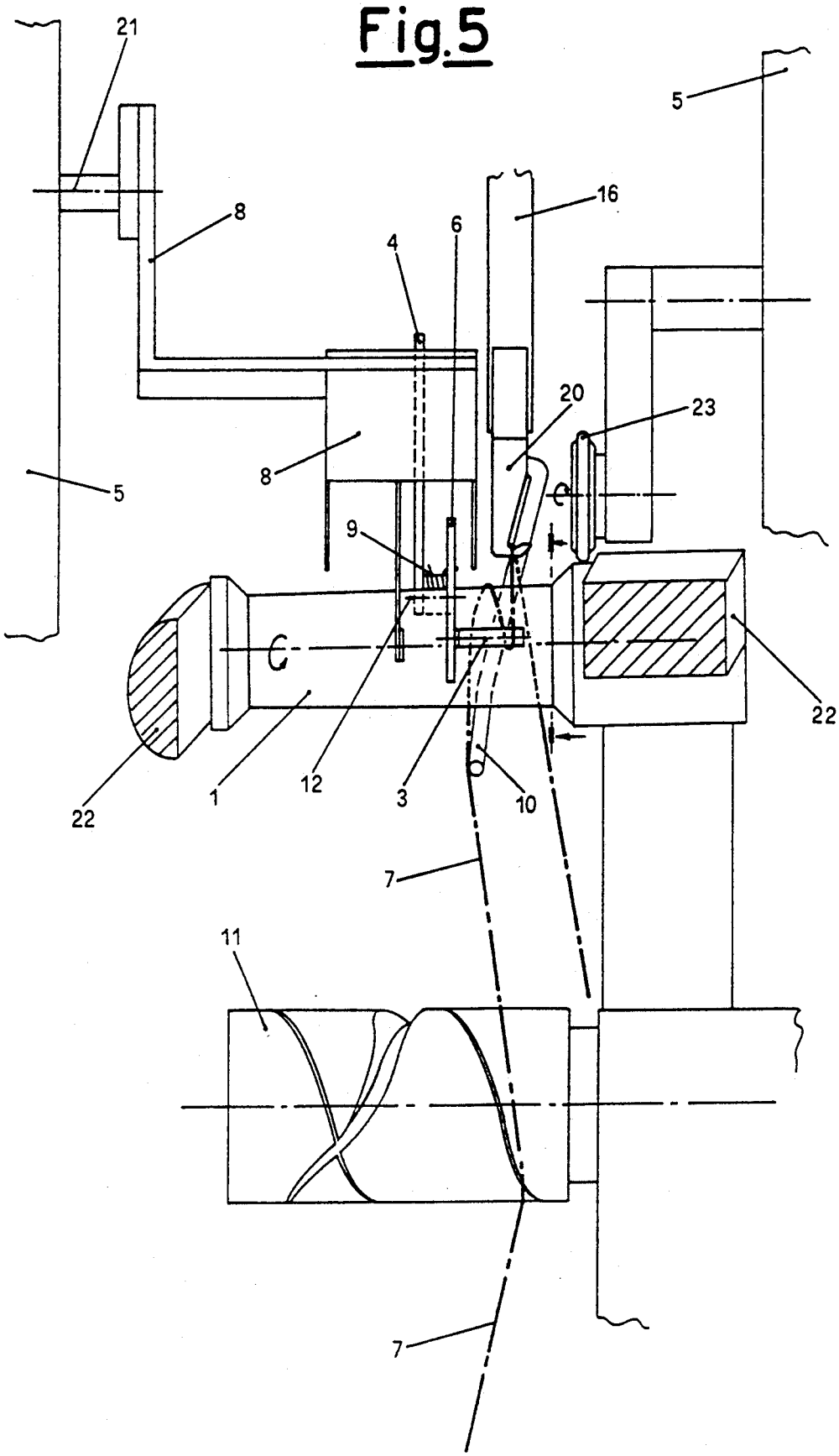
FIG. 5 is a front schematic view of the operating moment shown in FIG. 4 and also shows, in the working position, the friction wheel which is activating rotation of the bobbin to deposit the first coils of wound thread.

The device covered by the present invention, illustrated in detail in the attached Figures, operates in a manner which is easily understood. There now follows a description of the operating sequence of the device for anchoring the thread to the surface of the winding bobbin on changing reel 14, i.e. on lifting out a full reel 14 to replace it with an empty bobbin 1. The known lifting carriage 5 is moved along the winding front until it is positioned at the spooling unit in which the lift is required. In this position arm 8 picks up bobbin 1 from a bobbin supply device of the appropriate constructional type and of known state of the art while the thread extends uninterrupted and taut from the cop of thread below (not shown) to reel 14 which is full of wound thread and being unloaded as shown in FIG. 1. Thread 7 is held by gripper element 20 the end of which is in the form of a hook and the said thread 7 is also positioned by the end of movable portion of sheeting 15. Curved lever 6 pushes against bobbin 1. In the next stage arm 8 is activated to rotate angularly around pin 21 to place bobbin 1 between the centres of reel-carrier mandrel 22. The said rotation is brought about by known means housed in carriage 5. In the said angular rotation bobbin 1 interferes with taut thread 7 which partly winds round it along a circumferential sector when the bobbin is positioned and gripped between the centres of mandrel 22 (see FIG. 2). At the same time or in sequence with the rotation of arm 8 movable sheeting 15 is lowered. Curved lever 6, remaining with its essentially flat end in contact with the surface of bobbin 1, keeps roller 3 at a slight distance from the said surface of bobbin 1. In the next stage, on placing and gripping bobbin 1 between the centres of mandrel 22, the angular movement of rod-shaped element 10 and the axial movement of hooked gripper element 20 is activated at the same time. The said movements are illustrated schematically in front view in FIG. 3 and more precisely, the rod element moves from position 10*a* to position 10 and the hooked gripper element moves from position 20*a* to position 20; this is to force thread 7 to move from position 7*a* to position 7. In this last position thread 7 winds round roller 3. Incidentally, the above-mentioned movements are activated by actuator 16. In the stage after the above-described movements the end of arm 8 finally leaves bobbin 1, already fixed to mandrel 22, and moves angularly upwards. This slight angular rotation causes curved lever 6 to rotate round pin 12 pushed by coiled spring 9 which forces the said lever 6 to remain pressed against the surface of bobbin 1. Due to the effect of the said angular rotation the contact of lever 6 shifts from its flat end to roller 3 fixed freely to it. Thread 7 winds round bobbin 1 around a considerable circumferential arc and is pressed tightly against the surface of bobbin 1 by roller 3 (see FIG. 4). Partly overlapping this latter operating stage cutter element 2 is activated by acutator 16 and its rod 18. Thread 7 is cut thus releasing reel 14 which is recovered by a conveyor belt (not shown). In the next stage friction wheel 23 is brought close to one end of mandrel 22 and is made to rotate, by known means, to impart a few rotations to bobbin 1 so that the first coils of thread 7 wind onto it (see FIG. 5). The hookup and start of depositing the first coils of wound thread occurs with assured reliability since the initial end of the thread is held and, with maximum safety, brought close to the surface of bobbin 1 by free roller 3. The said initial windings hook on and secure themselves to the surface of bobbin 1 in an axial section inside the axial extent of the thread contained on the thread package that will start to form with windings of criss-cross thread in the spooler. On completing the above-mentioned initial depositing operation friction wheel 23 rises releasing its contact with mandrel 22 and elements 8, 16, 10 together with their operating means reposition themselves inside lifting carriage 5. The cycle for changing reel 14 is thus completed and the device covered by the present invention may be moved to another spooler by movable carriage 5. The above-described embodiment has been given by way of example and in no way limits the invention. Variants, modifications and additions may of course be made by experts within the field to the details of the device without going beyond the general concept of the present invention.

We claim:

1. In a winding machine, a device for anchoring thread to the surface of a bobbin, comprising:

a) a moveable arm attached to the winding machine for grasping and moving the bobbin, wherein said moveable arm has a lever fixed thereto;

b) a member rotatably connected to said lever, wherein said member has a roller thereon for contacting the surface of the bobbin;

c) a mandrel for holding and rotating the bobbin while the thread is wound onto the bobbin, wherein said mandrel is adapted to receive the bobbin from said moveable arm; and d) thread positioning means for positioning the thread between the surface of the bobbin and said roller when the thread is to be anchored on the bobbin.

2. The device of claim 1, wherein said thread positioning means includes a gripper element for gripping the thread, a cutter element for cutting the thread, and a rod for placing the thread between said roller and the surface of the bobbin.

3. The device of claim 1, further comprising a biasing element positioned between said lever and said member for predisposing said roller upon the surface of the bobbin.

4. In a winding machine, a method for anchoring thread to the surface of a bobbin, comprising:

a) grasping and moving the bobbin by means of a moveable arm attached to the winding machine, wherein said arm has a lever fixed thereto, wherein said lever has a member rotatably connected to said lever, and wherein said member has a roller thereon for contacting the surface of the bobbin;

b) receiving the bobbin in a mandrel from said moveable arm, wherein said mandrel is adapted for holding and rotating said bobbin; and c) positioning the thread between the surface of the bobbin and said roller by a thread positioning means so that when said mandrel rotates the bobbin and said roller contacts the surface of the bobbin, the thread is anchored to the bobbin.

* * * * *